US008393604B2

(12) United States Patent
Bundy

(10) Patent No.: US 8,393,604 B2
(45) Date of Patent: Mar. 12, 2013

(54) TAPE GUN HOLDER DEVICE

(76) Inventor: Richard V. Bundy, Toano, VA (US)

( * ) Notice: Subject to any disclaimer, the term of this patent is extended or adjusted under 35 U.S.C. 154(b) by 190 days.

(21) Appl. No.: 12/880,002

(22) Filed: Sep. 10, 2010

(65) Prior Publication Data

US 2012/0061414 A1 Mar. 15, 2012

(51) Int. Cl.
*B23Q 3/00* (2006.01)
*A47G 29/00* (2006.01)

(52) U.S. Cl. ..... 269/287; 248/121; 248/125.3; 221/1

(58) Field of Classification Search ..... 269/43; 248/316.4, 309.1; 211/64
See application file for complete search history.

(56) References Cited

U.S. PATENT DOCUMENTS 1,879,024 A * 9/1932 Barto, Jr. ..... 29/213.1
3,031,069 A * 4/1962 Hirsch ..... 206/317
3,473,673 A * 10/1969 Porter ..... 211/64
3,727,868 A * 4/1973 Buchanan ..... 248/205.3
5,033,709 A * 7/1991 Yuen ..... 248/313
5,072,909 A * 12/1991 Huang ..... 248/311.2
5,305,381 A * 4/1994 Wang et al. ..... 379/455
5,385,325 A * 1/1995 Rigsby ..... 248/313
5,457,745 A * 10/1995 Wang ..... 379/454
5,697,071 A * 12/1997 Fan ..... 455/575.9
D391,266 S * 2/1998 Richter ..... D14/253
D393,002 S * 3/1998 Mandar ..... D19/78
5,788,202 A * 8/1998 Richter ..... 248/316.4
5,836,563 A * 11/1998 Hsin-Yung ..... 248/316.4
5,961,016 A * 10/1999 Hartmann et al. ..... 224/571
5,988,615 A * 11/1999 Churoux ..... 269/3
6,550,128 B1 * 4/2003 Lorenz ..... 29/464
6,785,567 B2 * 8/2004 Kato ..... 455/575.9
7,017,243 B2 * 3/2006 Carnevali ..... 24/523
7,137,511 B1 * 11/2006 Crowell et al. ..... 211/4
7,207,368 B1 * 4/2007 Lyman, Jr. ..... 156/523
7,251,324 B2 * 7/2007 Richter ..... 379/454
7,407,143 B1 * 8/2008 Chen ..... 248/309.1
7,467,719 B2 * 12/2008 Crowell et al. ..... 211/64
7,540,459 B2 * 6/2009 Asano et al. ..... 248/309.1
D608,357 S * 1/2010 Peyridieu ..... D14/253
D611,558 S * 3/2010 Freeman ..... D22/108
7,669,816 B2 * 3/2010 Crain et al. ..... 248/183.3
7,731,141 B2 * 6/2010 Schuerch ..... 248/230.3
D632,737 S * 2/2011 Pascale ..... D19/65
8,037,917 B2 * 10/2011 Steele et al. ..... 156/523
2005/0279902 A1 * 12/2005 Richter ..... 248/316.4
2008/0067211 A1 * 3/2008 Steele et al. ..... 225/77

OTHER PUBLICATIONS

"Tape Wrangler", www.tapewrangler.com, Traverse City, Michigan, USA, Phone: 866-437-8273. (See attached 2 page product flyer).

* cited by examiner

*Primary Examiner* — Lee D Wilson
*Assistant Examiner* — Jamal Daniel
(74) *Attorney, Agent, or Firm* — David Quinn

(57) ABSTRACT

In an exemplary embodiment, the present invention provides a device comprising a platform and a handle end seat coupled to the platform. The handle end seat is configured to seat therein a handle end of a handle of a hand-held tape dispensing gun. The device includes a gun handle cradle coupled to the platform and spaced from the handle end seat. The gun handle cradle is configured to secure the handle of the hand-held tape dispensing gun. In operation, the device securely holds the tape dispensing gun vertically or horizontally so that the user's hands are freed to dispense various lengths of tape from the roll of tape in the gun.

13 Claims, 6 Drawing Sheets

TAPE GUN HOLDER DEVICE

NOTICE OF COPYRIGHT PROTECTION

A portion of the disclosure of this patent document and its figures contain material subject to copyright protection. The copyright owner has no objection to the facsimile reproduction by anyone of the patent document or the patent disclosure, but otherwise reserves all copyrights whatsoever.

BACKGROUND

I. Field

The invention relates to holders for tape dispensing guns, taping systems, tape dispensers, tape cutters, and tape applicators.

II. Background

Existing commercial hand-held tape dispensers or guns have several features which make them difficult to use when needed to dispense tape from the tape roll and especially, tape pieces of relatively short length. Tape dispensing guns have a receptacle to receive a tape roll from which tape of the tape roll is dispensed and a cutting element to cut the dispensed tape.

In operation, an operator, while holding a tape dispensing gun, places a free-end of the tape directly on a package. Thereafter, the operator pulls and/or rolls the tape dispensing gun in a direction which unwinds or unrolls the tape from the tape roll in the receptacle to effectuate dispensing of a length of tape. The cutting element of the tape dispensing gun cuts the tape to release the dispensed length of tape from the remaining tape on the tape roll. Generally, the tape is cut using the cutting element by manipulating the tape dispensing gun, with the operator's hands, to move and press the cutting element directly on the dispensed tape. Sometimes, as the operator manipulates the tape dispensing gun, the tape becomes twisted and bunched so that portions may be adhesively attached or overlapping. As can be appreciated, tape dispensing guns are bulky and difficult to use to dispense any length of tape.

Small lengths of tape are hard to cut because the dispenser is designed to cut tape after a length of tape (approximately 6 inches) has been dispensed. Furthermore, the tape easily tangles due to the pressure required to start the dispensing operation of the tape or to cut the tape.

Some operator's need to use their hands to get the tape untwisted, cut or installed. In such instances, the operator may hold a handle of the tape dispensing gun between the knees or legs or sometimes under their arms. Hand-held tape dispensing guns generally require a person's hand to hold a handle to dispense tape from the roll but are bulky and difficulty to use.

Current hand-held tape dispensing guns lack a convenient holder to dispense tape from the tape dispensing gun without the need to hold the gun and, especially, the gun handle in the operator's hand.

In view of the foregoing, there is a need for a tape dispensing gun holder device that simplifies storage and use of the hand-held tape dispensing gun to dispense various lengths of tape without the need to hold the gun handle when dispensing the tape.

SUMMARY

The aforementioned problems, and other problems, are reduced, according to exemplary embodiments, by the tape dispensing gun holder device described herein below.

In an exemplary embodiment, the present invention provides a device comprising a platform and a handle end seat coupled to the platform. The handle end seat is configured to seat therein a handle end of a handle of a hand-held tape dispensing gun. The device includes a gun handle cradle coupled to the platform and spaced from the handle end seat. The gun handle cradle is configured to secure the handle of the hand-held tape dispensing gun. In operation, the device securely holds the tape dispensing gun vertically or horizontally so that the user's hands are freed to dispense various lengths of tape from the roll of tape in the gun.

In another exemplary embodiment, the present invention provides a device comprising means for seating a handle end of a handle of a hand-held tape dispensing gun; means for cradling and securing the handle; and means for mounting the seating means and the cradling means in adjustable space relationship to accommodate a length of the handle, and a means for storing writing utensils (pens, markers, etc).

In yet another exemplary embodiment, the present invention provides a method of dispensing tape from a hand-held tape dispensing gun using a device comprising a platform, a handle end seat coupled to the platform and configured to seat therein a handle end of a handle of the hand-held tape dispensing gun, and a gun handle cradle coupled to the platform and spaced from the handle end seat, the gun handle cradle being configured to secure therein the handle of the hand-held tape dispensing gun. The method comprises the steps of: seating the handle end of the handle in the handle end seat; cradling and securing the handle in the gun handle cradle; and dispensing tape from a tape roll supported by the tape dispensing gun.

Other systems, methods, and/or products according to embodiments will be or become apparent to one with skill in the art upon review of the following drawings, and further description. It is intended that all such additional systems, methods, and/or products be included within this description, be within the scope of the present invention, and be protected by the accompanying claims.

BRIEF DESCRIPTION OF THE DRAWINGS

The exemplary embodiments, objects, uses, advantages, and novel features are more clearly understood by reference to the following description taken in connection with the accompanying figures wherein.

DESCRIPTION

The word "exemplary" is used herein to mean "serving as an example, instance, or illustration." Any configuration or design described herein as "exemplary" is not necessarily to be construed as preferred or advantageous over other configurations or designs. Furthermore, use of the words "present invention" is used herein to convey only some of the embodiments of the invention. For example, the words "present invention" would also include alternative embodiments and equivalent systems and components that one of ordinary skill the art understands. An example is that the materials used for the exemplary embodiments may be made out of man-made materials, natural materials, and combinations thereof. A further example is that the apparatus or components of the apparatus may be manufactured by machine(s), human(s) and combinations thereof.

Some of the embodiments of the invention now will be described more fully hereinafter with reference to the accompanying drawings, in which exemplary embodiments are shown. This invention may, however, be embodied in many different forms and should not be construed as limited to the embodiments set forth herein. These embodiments are provided so that this disclosure will be thorough and complete and will fully convey the scope of the invention to those of ordinary skill in the art. Moreover, all statements herein reciting embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Figure 1A:
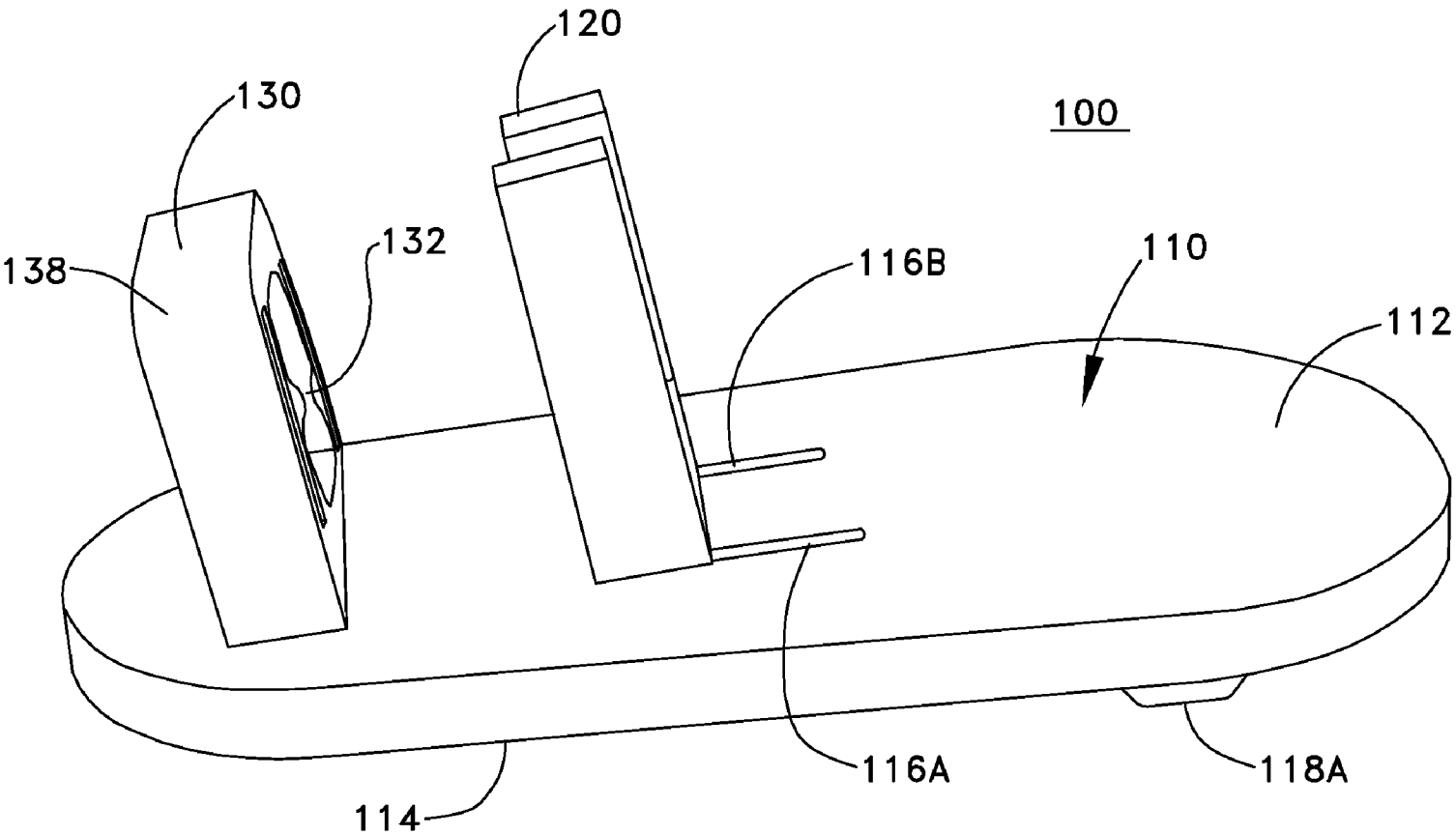
FIG. 1A illustrates a perspective view of the tape dispensing gun holder device in accordance with some exemplary embodiments of the present invention.
Figure 1B:
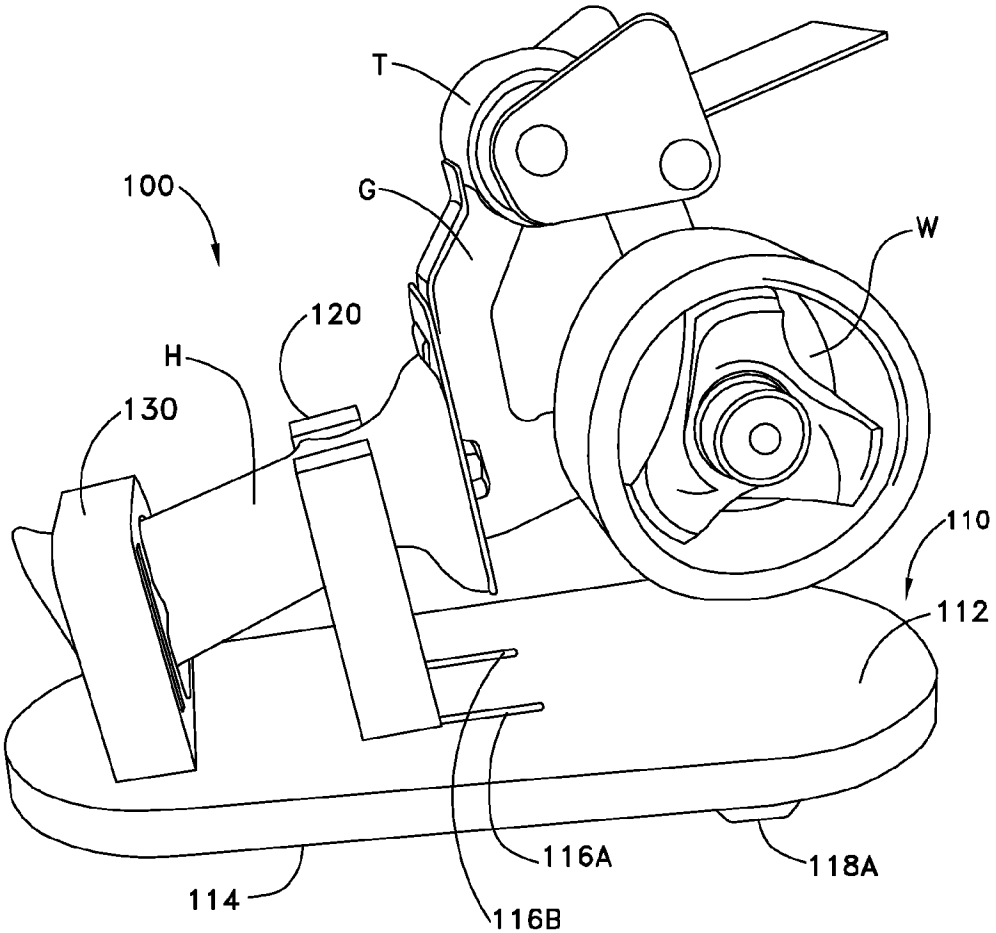
FIG. 1B illustrates a perspective view of the tape dispensing gun holder device with a tape dispensing gun cradled in accordance with some exemplary embodiments of the present invention.
Figure 2:
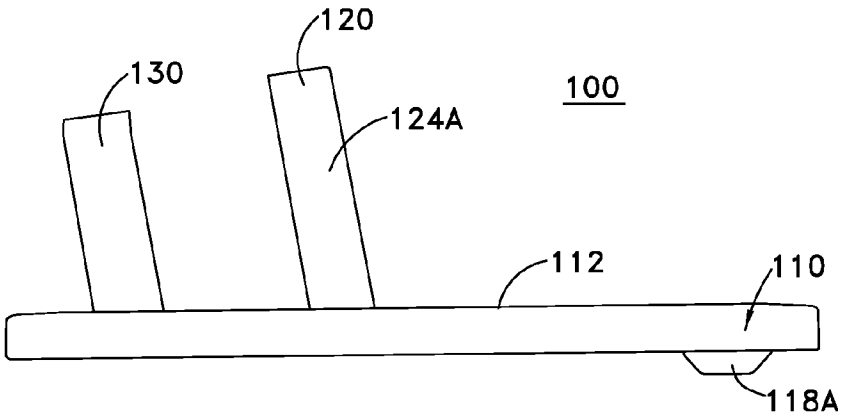
FIG. 2 illustrates a side view of the tape dispensing gun holder device of FIG. 1A.
Figure 3:
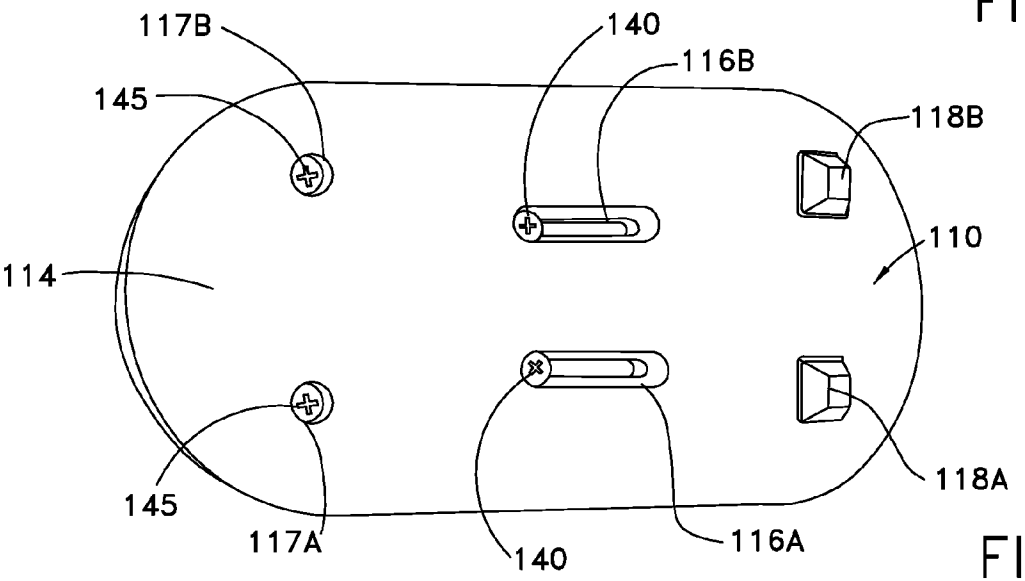
FIG. 3 illustrates a bottom view of the tape dispensing gun holder device of FIG. 1A.
Figure 5:
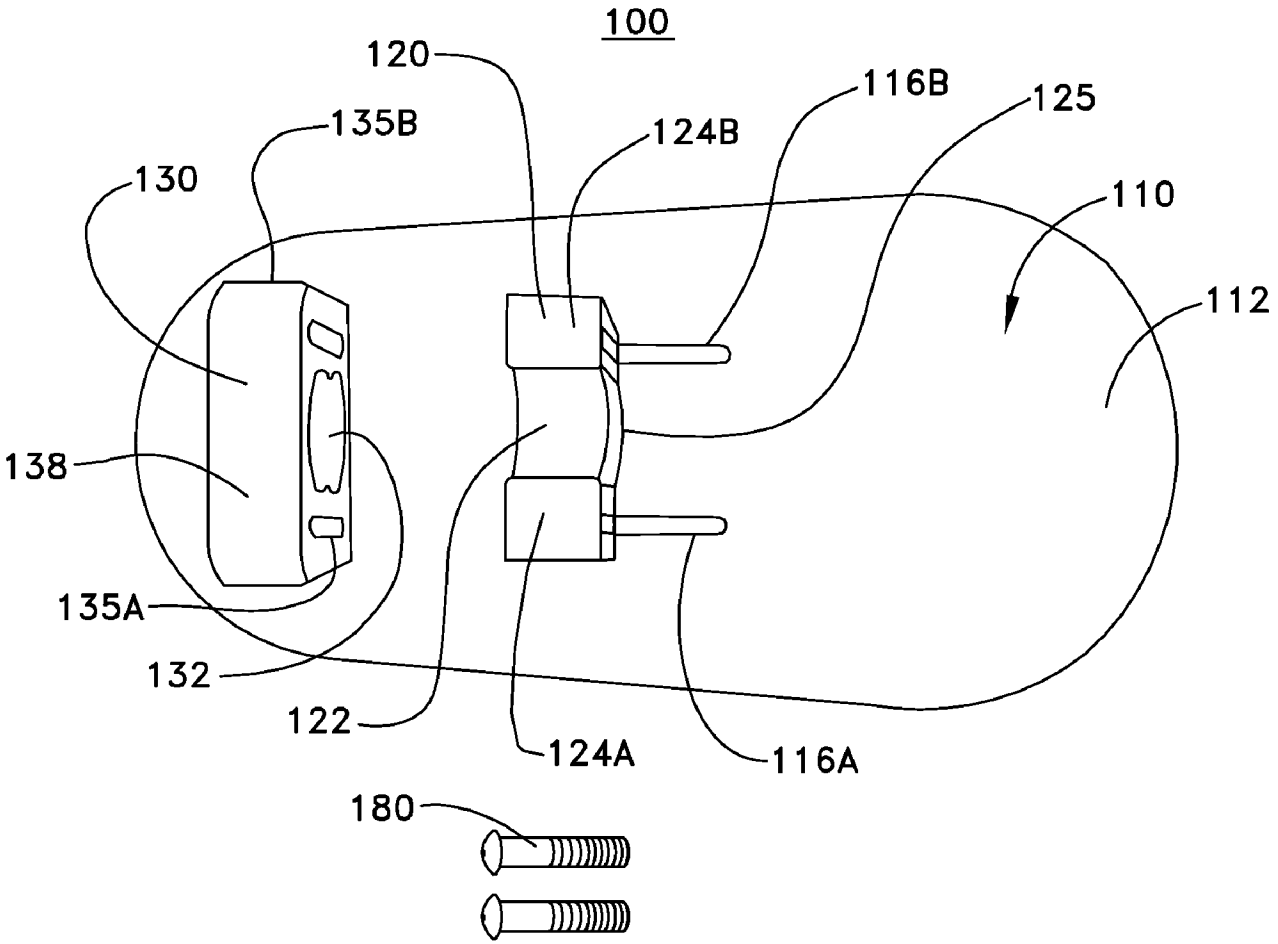
FIG. 5 illustrates a top view of the tape dispensing gun holder device of FIG. 1A.

FIG. 1A illustrates a perspective view of the tape dispensing gun (TG) holder device 100 in accordance with some exemplary embodiments of the present invention. FIG. 1B illustrates a perspective view of the tape dispensing gun holder device 100 with a pistol-grip tape dispensing gun G cradled in accordance with some exemplary embodiments of the present invention. FIGS. 2-3 and 5 illustrate side, bottom and top views, respectively, of the TG holder device 100 of FIG. 1A. The TG holder device 100 is configured to hold hand-held tape guns, pistol-grip tape dispensing gun, or the like, such as by 3M™ Corporation or other manufacturers. The hand-held tape dispensing gun or pistol-grip tape dispensing gun dispenses packaging tape to seal or close boxes and/or wrapping paper for boxes, presents, etc.

The tape may be a variety of adhesive tapes such as. packing tape, strapping tape, electrical tape, masking tape, duct tape, polypropylene tape, sealing tape, and clear tape such as used in various taping systems.

The TG holder device 100 is configured to support, cradle, balance and/or hold a handle H of a tape dispensing gun G and allow for tape T to be dispensed from the tape dispensing gun G without the need to hold the handle H of the tape dispensing gun G. The TG holder device 100 is configured to support the tape dispensing gun G horizontally as shown in FIG. 1B. However, the TG holder device 100 may be attached or mounted to a wall via fasteners 180 (FIG. 5) or other support surfaces which may be vertical or horizontal. Thus, the TG holder device 100 is configured to adapt the tape dispensing gun G for hands free operation to allow a user to dispense tape from the tape roll while the tape dispensing gun G is cradled vertically or horizontally in the TG holder device 100.

For illustrative purposes, the tape dispensing gun G has a wheel W used to help guide the tape dispensing gun G along a box or package when dispensing the tape T. However, it should be appreciated that the tape dispensing gun G has many different configurations and the wheel W may be omitted. The handle H may have different configuration including the length and diameter.

The TG holder device 100 includes a platform 110 having a top surface 112 and a bottom surface 114. In an exemplary embodiment, the bottom surface 114 has attached thereto feet or pads 118A and 118B (FIG. 3) configured to raise a front end of the platform 110. The feet or pads 118A and 118B are affixed to the bottom surface 114 in proximity to a front end of the platform 110. The feet or pads 118A and 118B may be permanently affixed to the bottom surface 114 or adhesively attached and removable. The feet or pads 118A and 118B may be fastened or affixed to the bottom surface using other attachment or fastening systems such as screws, glue, bonding glue, snap-on operation or the like.

The TG holder device 100 further includes an adjustable gun handle cradle 120 and a handle end seat 130. The adjustable gun handle cradle 120 is adjustably mounted to platform 110. The platform 110 includes at least one slide channel 116A. In an exemplary embodiment, the platform 110 includes a pair of slide channels 116A and 116B in parallel spaced relation and having a length. The slide channels 116A and 116B receive fasteners 140 (FIG. 3) configured to fasten the gun handle cradle 120 to the platform 110. The adjustable gun handle cradle 120 is adjusted with respect to the handle end seat 130 so as to accommodate the varying lengths of the handle H of the tape dispensing gun G.

The adjustable gun handle cradle 120 can be slid along the length of the slide channels 116A and 116B and fastened to a particular location in the channels 116A and 116B by tightening the fasteners 140. In an exemplary embodiment, the fasteners 140 are screws. However, other fasteners may be used.

In the exemplary embodiment, the slide channels 116A and 116B are formed in the platform 110 and extend through the thickness of the platform 110. However, the slide channels 116A and 116B and fasteners 140 form an adjustment mechanism to allow the gun handle cradle 120 to be adjusted. The adjustment mechanism may include slide channels which are hardware that is attached to the platform 110 that serve to allow the gun handle cradle 120 to be adjusted or slid with respect to the handle end seat 130.

The platform 110 further includes at least one through hole 117A and 117B. The handle end seat 130 is fastened to the platform 110 via fasteners 145 (FIG. 3) received through and fastened in the at least one through hole 117A and 117B. In an exemplary embodiment, the fasteners 145 are screws. However, other fasteners may be used. For example, the handle end seat 130 may be permanently affixed to the platform 110 via an adhesive, bonding glue, glue or other fasteners.

In an exemplary embodiment, the handle end seat 130 is fixed with respect to the platform 110 and, specifically, with respect to the back end of the platform. However, the handle end seat 130 may be adjustable with respect to the gun handle cradle 120. Nonetheless, both the handle end seat 130 and the gun handle cradle 120 may be adjustable using slide channels or other means to allow the distance between the handle end seat 130 and the gun handle cradle 120 may be adjusted. For example, a slide channel or adjustment mechanism may be affixed to or integrated with the platform 110 that couple to both the handle end seat 130 and the gun handle cradle 120 and which allows both to be adjusted with respect to the other. Handles H have different lengths. Therefore, the ability to adjust for the handle lengths provides for universal adaptability.

The details of the adjustable gun handle cradle 120 and a handle end seat 130 will now be described in detail in relation to FIGS. 1A, 1B, 2, 3, 4A, 4B and 5. FIG. 4A illustrates a first end view of the TG gun holder device 100 in accordance with some exemplary embodiments of the present invention. FIG.

4B illustrates a second end view of the TG holder device in accordance with some exemplary embodiments of the present invention. The details of the handle end seat 130 are best seen in relation to FIG. 4A. The details of the adjustable gun handle cradle 120 are best seen in relation to FIG. 4B.

The handle end seat 130 includes a block 138 having an opening 132 flanked by channels 135A and 135B. The opening 132 is contoured to create a seat configured to receive an end or butt end of handle H of the tape dispensing gun G. In an exemplary embodiment, the opening 132 has a peanut or figure eight (8) outline or profile. The top portion 133A of opening 132 forms a generally circular profile. The bottom portion 133B of opening 132 forms a generally circular profile below the top portion 133A. As the top portion 133A and the bottom portion 133B merge together or overlap, seat ribs 134A and 134B are formed. Seat rib 134A is adjacent to channel 135A. Seat rib 134B is adjacent to channel 135B.

The opening 132 is a closed hole in the block 138 so that the handle end is secured as the handle H is secured, fastened, snapped in or friction fit coupled in the cradle 120 or remains secured as tape is dispensed.

The channels 135A and 135B are on right and left sides, respectively, of opening 132 and have longitudinal axes which are parallel to a longitudinal axis of the opening 132. The channels 135A and 135B are elongated through holes or channels formed through the thickness of the block 138. Therefore, the section of block between the opening and the channel 135A forms a first seat resilient member, the first seat resilient member having seat rib 134A. Likewise, the section of block between the opening and the channel 135B forms a second seat resilient member, the second seat resilient member having seat rib 134B. In operation, when the handle end or butt end is received in the opening 132, the handle end or butt end are friction fit coupled within the opening 132 by the applied force via seat ribs 134A and 134B thereto.

Figure 4B:
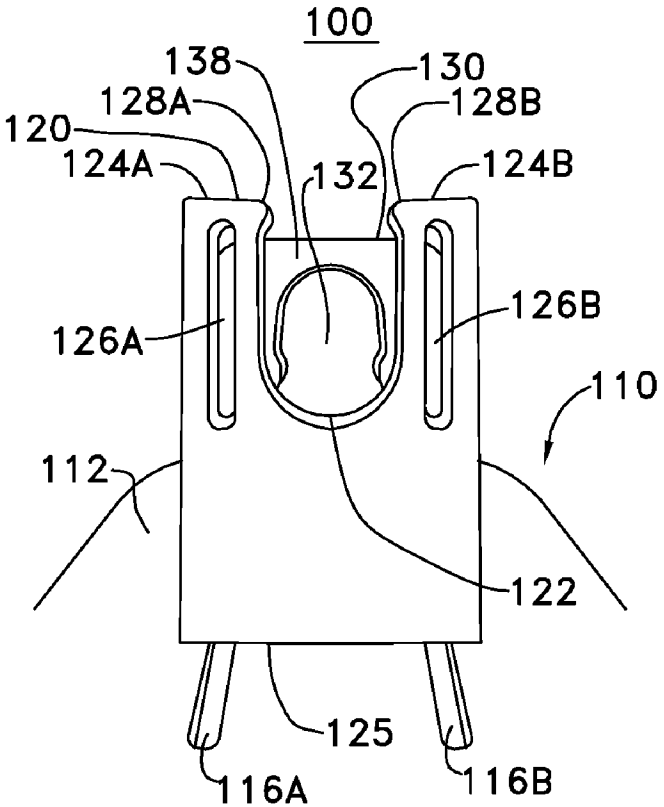
FIG. 4B illustrates a second end view of the tape dispensing gun holder device of FIG. 1A.
Figure 4A:
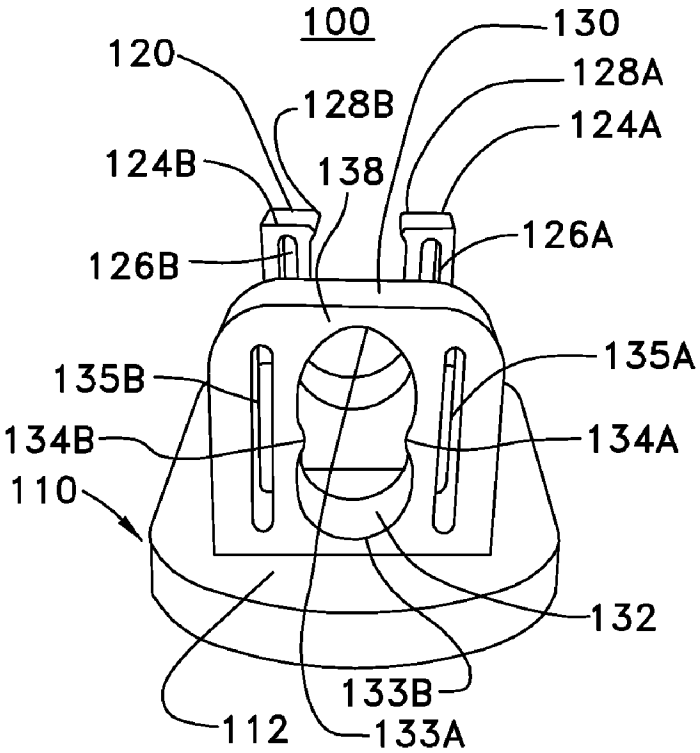
FIG. 4A illustrates a first end view of the tape dispensing gun holder device of FIG. 1A.

As best seen in FIG. 4B, the adjustable gun handle cradle 120 includes a block 125 having a U-shaped opening 122 formed therein. The U-shaped opening 122 providing a cradle to place the handle H of the tape dispensing gun G. The bottom end of the block 125 includes holes (not shown) for the receipt of fasteners 140. The top end of block 125 has the U-shaped opening 122.

In the exemplary embodiment, the U-shaped opening 122 forms cradle supports 124A and 124B in the block 125. The cradle supports 124A and 124B have flared top ends 128A and 128B, respectively. The fared top ends 128A and 128B are flared in the direction toward a center of opening 122. Furthermore, the cradle supports 124A and 124B have formed therein channels 126A and 126B, respectively, of opening 122. The flared top ends 128A and 128B reduces the clearance of the U-shaped opening 122 at the very top or beginning of the opening 122. The term clearance is defined as the distance between cradle supports 124A and 124B.

The channels 126A and 126B have longitudinal axes which are parallel to a longitudinal axis of the opening 122. The channels 126A and 126B are elongated through holes or channels formed through the thickness of the block 125. Therefore, the section of block between the opening and the channel 126A forms a first cradle resilient member capable to flexing as the handle H is friction fit coupled or snapped into place. Likewise, the section of block between the opening 122 and the channel 126B forms a second cradle resilient member capable of flexing as the handle H is friction fit coupled or snapped into place as the handle H is pushed through the flared top ends 128A and 128B.

As best seen in FIG. 4B, the bottom of the U-shaped opening 122 is below seat ribs 134A and 134B.

In an exemplary embodiment, the adjustable gun handle cradle 120 is configured to provide a snap-in or friction fit coupling to hold a handle H of the tape dispensing gun into place. Other friction fit couplings or snap-in couplings may be used. For example, the block 125 is shown made of generally rigid material but constructed to provide resiliency and flexibility. Thus, the block 125 may be made of semi-rigid material or resilient or flexible materials that tightly friction fit couples the handle H in a cushioned cradle. The force exerted by the friction fit or snap-in coupling of cradle 120 should stabilize and secure the handle H of the tape dispensing gun G when the tape is unrolled or dispensed from the tape roll and cut.

The coupling of the handle H to cradle 120 and/or seat 130 provides a snap-in type of coupling. The holding force of the friction fit or snap-in coupling should allow the gun G to remain seated and cradled as tape T is dispensed using device 100.

The device 100 may be made of plastic, rigid plastic, semi-rigid plastic, wood, metal, synthetic material, natural material or a combination of synthetic material and natural material.

In operation, the handle H of the tape dispensing gun G is installed such that the handle end or butt is seated in the opening 132, as best seen in FIG. 1B. The front part of the handle H can be friction fit coupled or snapped-in to the seat 130. Thereafter, an upper end of the handle H or other portion of the tape dispensing gun G is cradled in the cradle 120. In an exemplary embodiment, the handle H and tape dispensing gun G are securely held and supported by the device 100. Thus, when tape is dispensed and cut, the tape dispensing gun G should be stabilized in the cradle 120 and seat 130 for ease of operation and dispensing of the tape.

The platform 110 of device 100 may be affixed to a support surface via fasteners 180 such as screws or the like. The support surface may be vertical or horizontal. For example, the support surface may be a desk, a work bench, a wall, a cabinet, etc. The fasteners 180 may be attached using channels 116A and 116B. Alternately, separate holes (not shown). may be used to attach the platform using fasteners. Furthermore, a mounting plate and bracket (not shown) or other hardware may be added to the back of the platform of device 100 to affix the platform to a support surface.

The platform 110 and blocks 125 and 138 are shown as structures having a thickness, width and height. However, the platform and blocks may be plates of varying thicknesses and dimensions.

Figure 6:
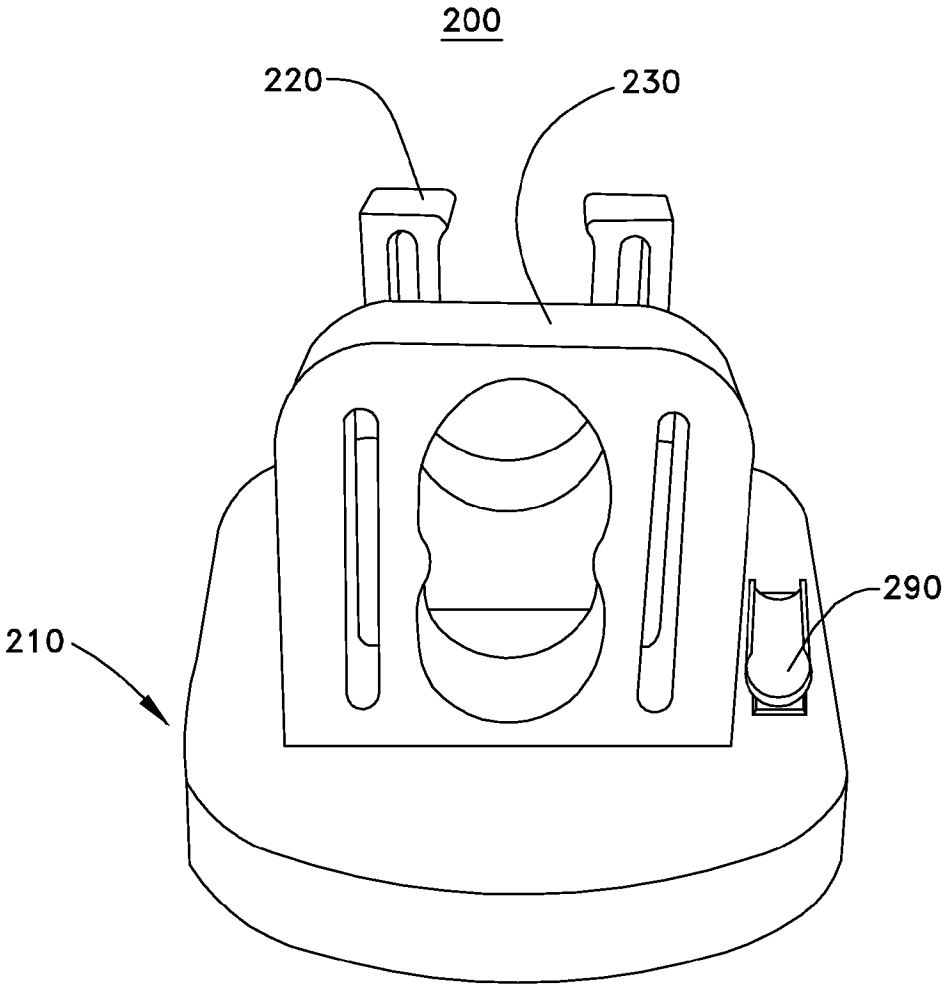
FIG. 6 illustrates a view of the tape dispensing gun holder device with a writing utensil holder.

FIG. 6 illustrates a view of the tape dispensing gun holder device 200 with a writing utensil holder 290. The writing utensil holder 290 is configured to hold or store markers, pens, pencils, or the like. The writing utensil holder 290 is resilient and flexible so that the utensil can be friction fit or snapped into place within holder 290. In order to remove the writing utensil, the utensil is lifted upward. When stored, the utensil is pressed into the holder cavity or ring.

The holder device 200 is similar to device 100 except that a writing utensil holder 290 has been added to the top side of the platform 210. The writing utensil holder 290 may be located in a variety of positions. However, for illustrative purposes, the writing utensil holder 290 is shown on the side of the adjustable gun handle cradle 120 and the handle end seat 230. The holder device 200 provides a tape dispensing gun caddy with added storage for writing utensils or writing implements. Therefore, when packaging the user can have the gun, tape and writing utensils together in a convenient storage unit.

While the present invention has been described with respect to various features, aspects, and embodiments, those skilled and unskilled in the art will recognize the invention is not so limited. Other variations, modifications, and alternative embodiments may be made without departing from the spirit and scope of the present invention.

What is claim is:

1. A device comprising:

means for seating a handle end of a handle of a hand-held tape dispensing gun;

means for cradling and securing the handle;

means for mounting the seating means and the cradling means in adjustable space relationship to accommodate a length of the handle; and means for storing a writing utensil.

2. The device according to claim 1, further comprising: feet coupled to a front end of the mounting means.

3. The device according to claim 1, wherein the seating means includes means for snapping-in or friction fit coupling therein the handle end.

4. The device according to claim 1, wherein cradling means includes means for snapping-in or friction fit coupling therein the handle.

5. The device according to claim 4, wherein the mounting means is configured to be vertically or horizontally supported and further comprising means for sliding the cradling means with respect to the seating means.

6. The device according to claim 5, further comprising means for attaching the mounting means to a support surface.

7. The device according to claim 1, wherein the seating means comprises an opening having a figure eight profile configured to snap therein the handle end; and the cradling means comprises a U-shaped opening configured to snap therein a portion of the handle.

8. A device comprising:

a platform;

a handle end seat coupled to the platform and configured to seat therein a handle end of a handle of a hand-held tape dispensing gun;

a gun handle cradle coupled to the platform and spaced from the handle end seat, the gun handle cradle being configured to secure therein the handle of the hand-held tape dispensing gun; and wherein the handle end seat comprises a closed aperture having opposing interior ridges configured to snap therein the handle end; and the gun handle cradle comprises a U-shaped opening configured to snap therein a portion of the handle.

9. The device according to claim 8, wherein spacing between the gun handle cradle and the handle end seat is adjustable.

10. The device according to claim 8, wherein the handle end seat includes a resilient seat configured with a snap-in or friction fit coupling.

11. The device according to claim 8, wherein gun handle cradle includes a resilient cradle with a snap-in or friction fit coupling.

12. The device according to claim 11, wherein the platform is configured to be vertically or horizontally supported and further comprising slide channels having slideably coupled therein the gun handle cradle.

13. The device according to claim 8, further comprising: feet coupled to a front end of the platform.

* * * * *